US009820572B1

(12) United States Patent
Kuehn

(10) Patent No.: US 9,820,572 B1
(45) Date of Patent: Nov. 21, 2017

(54) SHELF RACK

(71) Applicant: Target Brands, Inc., Minneapolis, MN (US)

(72) Inventor: Thomas P. Kuehn, St. Louis Park, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 15/460,593

(22) Filed: Mar. 16, 2017

(51) Int. Cl.
*A47B 87/00* (2006.01)
*A47B 87/02* (2006.01)
*A47B 47/00* (2006.01)

(52) U.S. Cl.
CPC ..... *A47B 87/0215* (2013.01); *A47B 47/0083* (2013.01); *A47B 87/001* (2013.01)

(58) Field of Classification Search
CPC ..... A47B 87/0215; A47B 87/0223; A47B 87/0246; A47B 47/0083
See application file for complete search history.

(56) References Cited

U.S. PATENT DOCUMENTS

| | | | | |
|---|---|---|---|---|
| 2,569,555 | A | 10/1951 | Chanslor et al. | |
| 3,536,016 | A | 10/1970 | Chesley | |
| 3,730,601 | A | 5/1973 | Misenheimer, III | |
| 4,757,769 | A | 7/1988 | Suttles | |
| D308,608 | S | 6/1990 | Arnold | |
| D365,227 | S | 12/1995 | Chambers et al. | |
| D425,723 | S * | 5/2000 | Hurt | D6/675.2 |
| D485,092 | S | 1/2004 | Rosen | |
| 6,796,565 | B2 | 9/2004 | Choi et al. | |
| 7,249,680 | B2 | 7/2007 | Wang | |
| 9,211,006 | B2 | 12/2015 | Chen | |
| 2004/0182810 | A1 | 9/2004 | Rosen | |
| 2011/0233164 | A1* | 9/2011 | Chang | A47B 57/14 211/188 |
| 2015/0001169 | A1* | 1/2015 | Chen | A47B 87/0223 211/188 |
| 2015/0014263 | A1* | 1/2015 | Lo | A47F 5/01 211/182 |
| 2015/0216299 | A1* | 8/2015 | Lai | A47B 87/0223 211/194 |
| 2016/0198850 | A1* | 7/2016 | Wall | A47B 87/0207 211/36 |

FOREIGN PATENT DOCUMENTS

| | | | |
|---|---|---|---|
| DE | 3906589 | A1 | 9/1989 |

* cited by examiner

*Primary Examiner* — Daniel J Rohrhoff
(74) *Attorney, Agent, or Firm* — Leanne Taveggia Farrell; Westman, Champlin & Koehler, P.A.

(57) ABSTRACT

A shelf rack includes first and second identical shelf units each including a first frame with first and second legs having respective first and second feet, a second frame with third and fourth legs having respective third and fourth feet and at least one shelf. The second and fourth feet have an outer diameter that is less than an outer diameter of the first and third feet. The second shelf unit is inverted and the first and second frames of the first shelf unit toollessly assemble to the first and second frames, respectively, of the second shelf unit by mating the larger outer diameter feet of the first shelf unit with the smaller outer diameter feet of the second shelf unit and mating the larger outer diameter feet of the second shelf unit with the smaller outer diameter feet of the first shelf unit.

20 Claims, 7 Drawing Sheets

SHELF RACK

BACKGROUND

Shelf racks are storage units designed for holding personal items, such as shoes. Shelf racks may be free-standing and may be placed inside a closet for the purposes of item organization. In some instances, shelf racks are modular so that components can be assembled in a variety of positions, heights and number of shelves.

The discussion above is merely provided for general background information and is not intended to be used as an aid in determining the scope of the claimed subject matter.

SUMMARY

A shelf rack includes first and second identical shelf units each including a first frame with first and second legs having respective first and second feet, a second frame with third and fourth legs having respective third and fourth feet and at least one shelf located between the first and second frames. The second and fourth feet have an outer diameter that is less than an outer diameter of the first and third feet. The second shelf unit is turned upside down and the first and second frames of the first shelf unit toollessly assemble to the first and second frames, respectively, of the second shelf unit. In the toollessly assembled first and second shelf units, the feet of the first shelf unit having the smaller outer diameter are mated with the feet of the second shelf unit having the larger outer diameter and the feet of the second shelf unit having the larger outer diameter are mated with the feet of the first shelf unit having the smaller outer diameter.

A shelf rack includes first and second identical shelf units. Each shelf unit includes a first frame including a continuous member and having a first end, a first bend, a second bend and a second end. Defined between the first end of the first frame and the first bend of the first frame is a first leg of each shelf unit, defined between the first bend and the second bend of the first frame is a top portion of the first frame and defined between the second bend and the second end of the first frame is a second leg of each shelf unit. Each unit includes a second frame including a continuous member and having a first end, a first bend, a second bend and a second end. Defined between the first end of the second frame and the first bend of the second frame is a third leg of each shelf unit, defined between the first bend and the second bend of the second frame is a top portion of the second frame and defined between the second bend and the second end of the second frame is a fourth leg of each shelf unit. At least one shelf is positioned between the first frame and the second frame of each of the first and second shelf units. The second shelf unit is inverted so that the first and second ends of the first frame of the second shelf unit mate with the first and second ends of the first frame of the first shelf unit and the first and second ends of the second frame of the second shelf unit mate with the first and second ends of the second frame of the first shelf unit to form an assembled shelf rack.

A method of assembling a shelf rack includes obtaining first and second identical shelf units each having a first frame, a second frame and at least one shelf therebetween. The second shelf unit is turned upside down so that a top of the second shelf unit rests on a floor. The first frame of the first shelf unit is toollessly connected to the first frame of the second shelf unit and the second frame of the first shelf unit is toollessly connected to the second frame of the second shelf unit to form the shelf rack. A top of the shelf rack comprises the top of the first shelf unit and a bottom of the shelf rack comprises the top of the second shelf unit.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

The stackable shelf unit described herein is configurable to either sit side-by-side next to or adjacent another identical stackable shelf unit or be stacked on top of the other identical stackable shelf unit. In the first configuration, the bottoms or feet of each stackable shelf unit are on the floor, the tops of each stackable shelf unit are located at a height above the floor and the identical stackable shelf units are positioned side-by-side or adjacent to each other. In the second configuration, one of the identical stackable shelf units is turned upside down and then the bottom of the lower stackable shelf unit mates with the bottom of the upper stackable shelf unit. This versatility in configurations provides options to the user for having a shelving rack with a shorter height and longer length or a shelving rack with taller height and a shorter length without having to separate individual components and recombine or reassemble the components in a different way.

Figure 1:
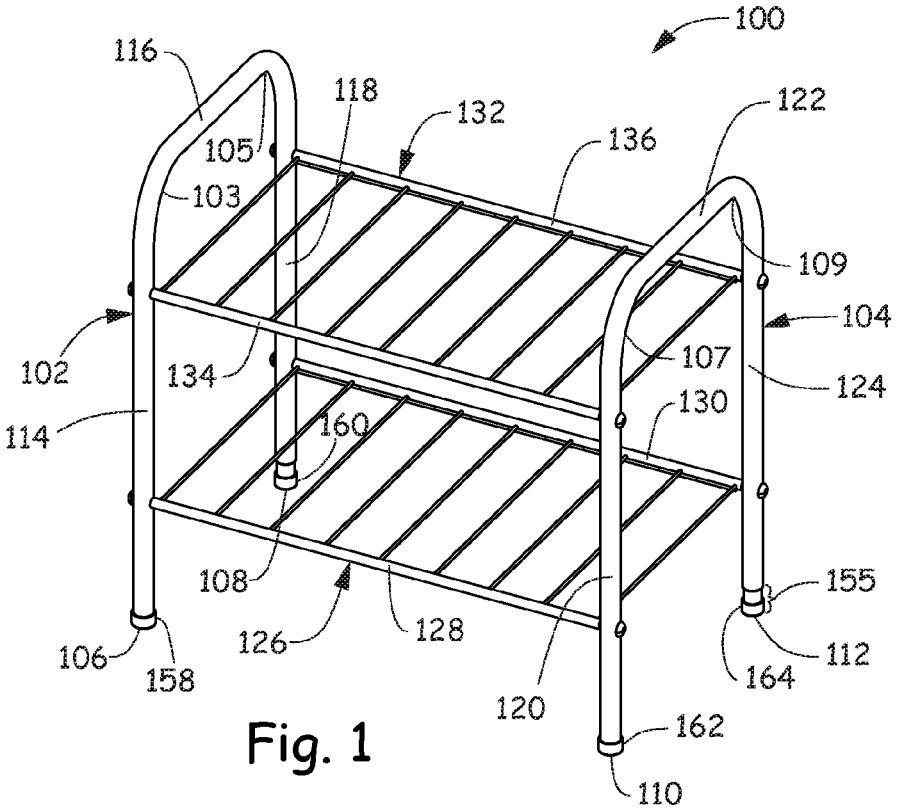
FIG. 1 is a perspective view of a stackable shelf unit according to one embodiment.
Figure 2:
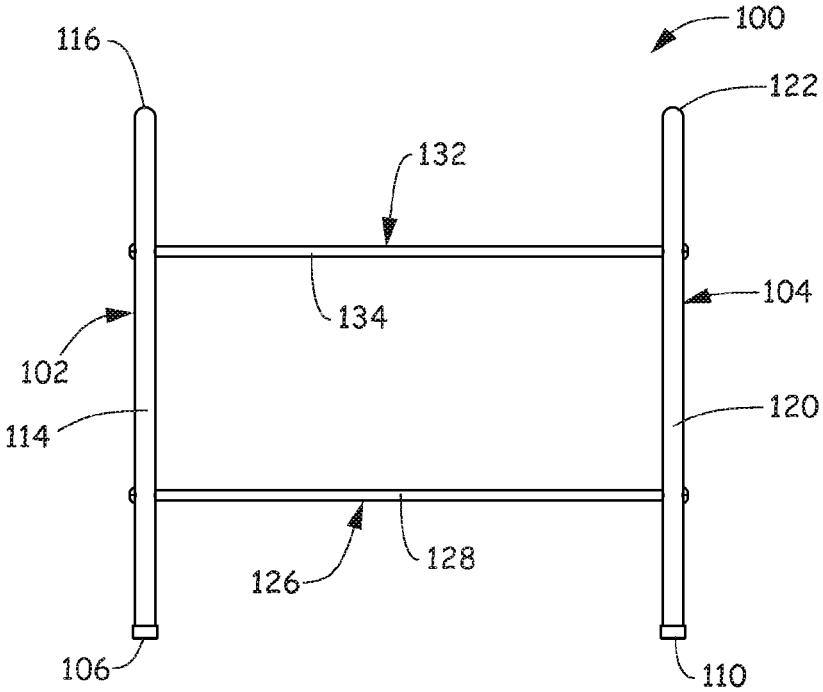
FIG. 2 is a front view of the stackable shelf unit of FIG. 1.
Figure 3:
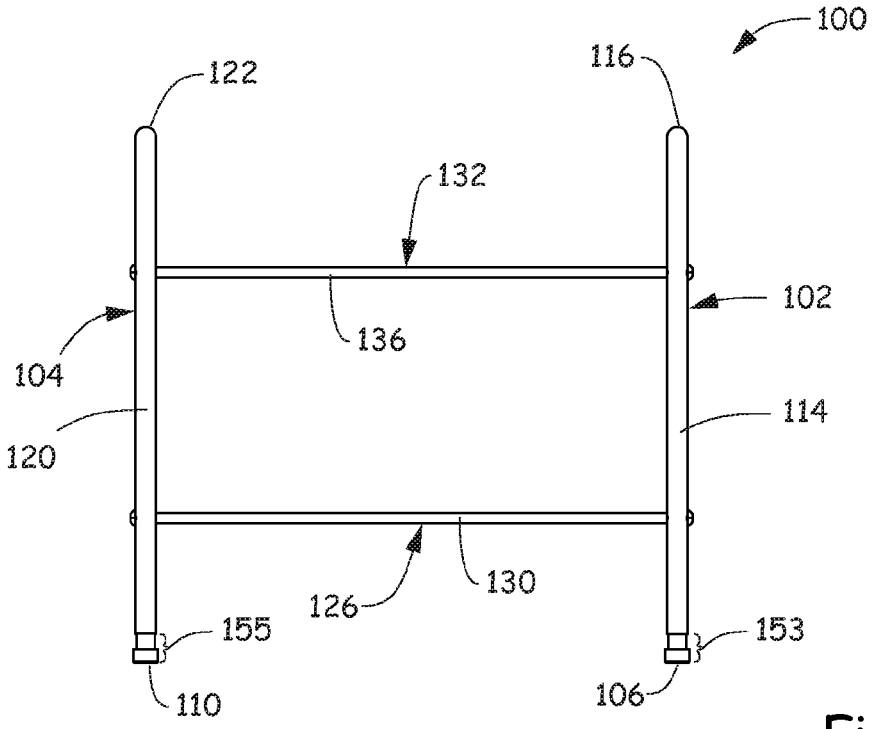
FIG. 3 is a back view of the stackable shelf unit of FIG. 1.
Figure 4:
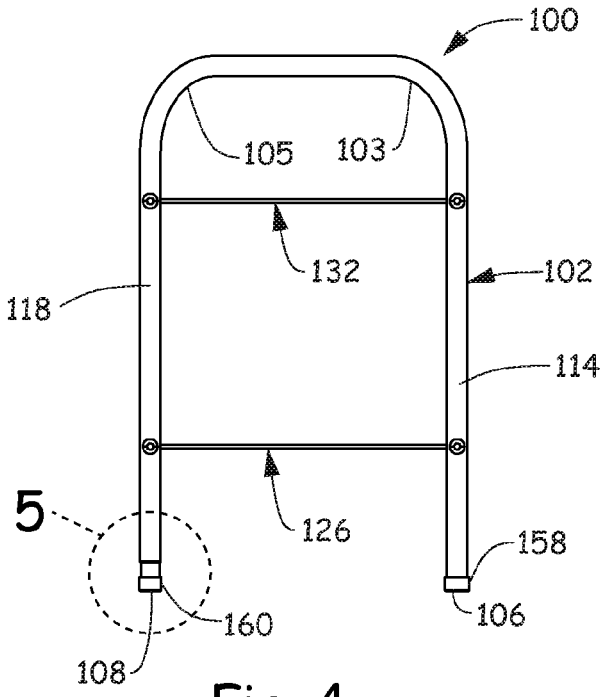
FIG. 4 a left side view of the stackable shelf unit of FIG. 1.

FIG. 1 is a perspective view of a stackable shelf unit 100 according to one embodiment. FIG. 2 is a front view, FIG. 3 is a back view and FIG. 4 is a left side view, the right side view being a mirror image of the left side view. Stackable shelf unit 100 includes first frame 102 and second frame 104. In one embodiment, each frame 102 and 104 is made of a single, continuous member, such as a continuous tubular member made of metal. A first end 106 of first frame 102 comprises a first foot and a second end 108 of first frame 102 comprises a second foot. A first end 110 of second frame 104 comprises a third foot and a second end 112 of second frame 104 comprises a fourth foot.

First frame 102 extends from first end or first foot 106 to a first bend 103 to define a first leg 114 of stackable shelf unit 100, extends from first bend 103 to a second bend 105 to define a top portion 116 of first frame 102 and extends from second bend 105 to second end or second foot 108 to define a second leg 118 of stackable shelf unit 100. Likewise, second frame 104 extends from first end or third foot 110 to a first bend 107 to define a third leg 120 of stackable shelf unit 100, extends from first bend 107 to a second bend 109 to define a top portion 122 of second frame 104 and extends from second bend 109 to second end 112 to define a fourth leg 124 of stackable shelf unit 100.

Located between first and second frames 102 and 104 is at least one shelf, such as a wire shelf having opposing ends that couple to or attach to each of first and second frames 102 and 104. In the embodiment illustrated in FIGS. 1-4, stackable shelf unit 100 has a plurality of shelves including a lower shelf 126 and an upper shelf 132. In FIGS. 1-4, lower shelf 126 is a wired shelf including a front rod 128 having left and right side ends, a back rod 130 that is substantially parallel to front rod 128 and having left and right side ends and a plurality of wires that extend between front rod 128 and back rod 130 that are substantially perpendicular to front rod 128 and back rod 130. Like lower shelf 126, in the embodiment illustrated FIGS. 1-4, upper shelf 132 is a wired shelf including a front rod 134 having left and right side ends, a back rod 136 that is substantially parallel to front rod 134 and having left and right side ends and a plurality of wires that extend between front rod 134 and back rod 136 that are substantially perpendicular to front rod 134 and back rod 136.

Figure 6:
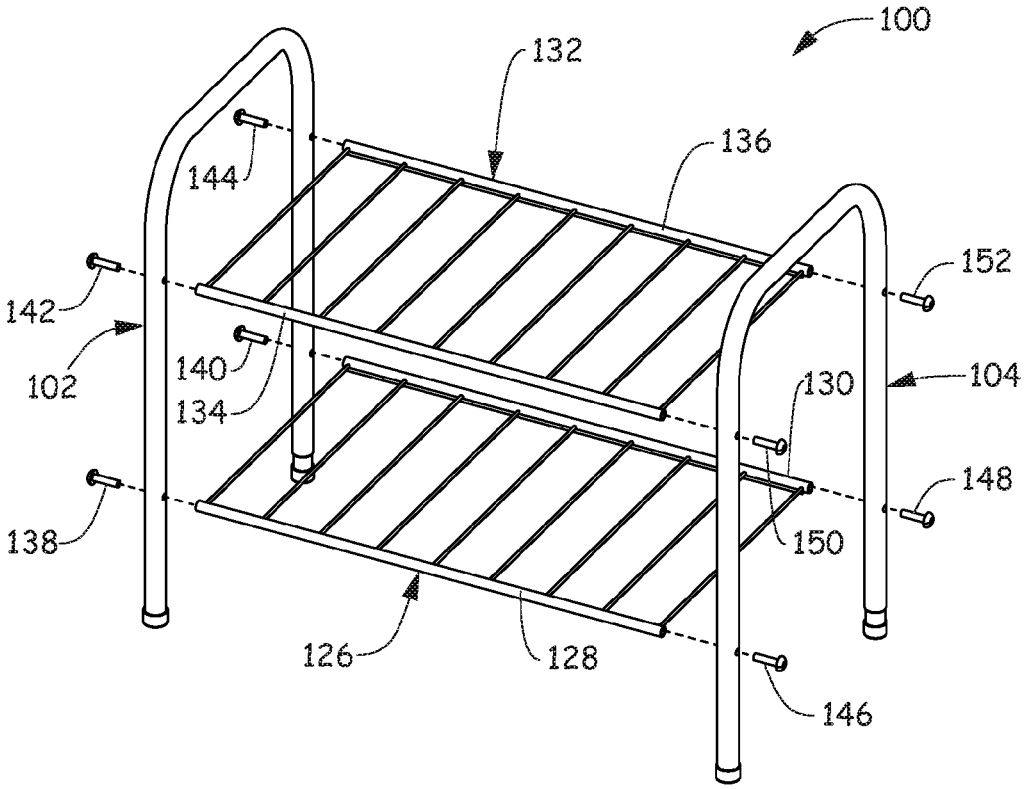
FIG. 6 is an exploded perspective view of the stackable shelf unit of FIG. 1.

FIG. 6 is an exploded perspective view of stackable shelf unit 100. As illustrated, lower shelf 126 and upper shelf 132 are each assembled to first frame 102 and second frame 104. In particular, left side ends of front rod 128 and back rod 130 of lower shelf 126 align with lower holes in first frame 102 and left side ends of front rod 134 and back rod 136 of upper shelf 132 align with upper holes in first frame 102. Fasteners 138 and 140 fasten the left side ends of front rod 128 and back rod 130 through the lower holes in first frame 102 and fasteners 142 and 144 fasten the left side ends of front rod 134 and back rod 136 through the upper holes in first frame 102.

Right side ends of front rod 128 and back rod 130 of lower shelf 126 align with lower holes in second frame 104 and right side ends of front rod 134 and back rod 136 of upper shelf 132 align with upper holes in second frame 104. Fasteners 146 and 148 fasten the right side ends of front rod 128 and back rod 130 through the lower holes in second frame 104 and fasteners 150 and 152 fasten the right side ends of front rod 134 and back rod 136 through the upper holes in second frame 104.

Figure 5:
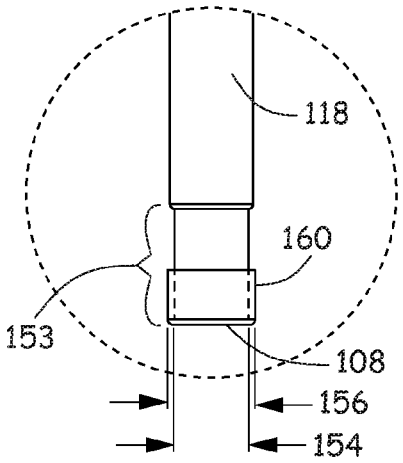
FIG. 5 is an enlarged view of a portion of the stackable shelf unit as indicated in FIG. 4.

FIG. 5 is an enlarged view of a portion of stackable shelf unit 100 as indicated in FIG. 4. In particular, FIG. 5 illustrates an enlarged view of a bottom of second leg 118 of first frame 102. As illustrated and partially by phantom lines in FIG. 5, a bottom section 153 extends from second end or second foot 108 to a point along second leg 118 of first frame 102 so that second end or second foot 108 of first frame 102 and bottom section 153 of second leg 118 have an outer diameter 154 that is less than an outer diameter 156 of the remaining section of second leg 118. As also illustrated in FIG. 5, attached to second end or second foot 108 of first frame 102 is a cap 160. Cap 160 is a second cap attached to second end or second foot 108 and a first cap 158 is attached to first end or first foot 106 of first frame 102. While second leg 118 of first frame 102 includes bottom section 153 having outer diameter 154, the entirety of first leg 114 of first frame 102 has the same outer diameter as the remaining section of second leg 118, which is substantially equal to outer diameter 156.

Likewise and as illustrated in FIGS. 1 and 3, a bottom section 155 extends from second end or fourth foot 112 to a point along fourth leg 124 of second frame 104 so that second end or fourth foot 112 of second frame 104 and bottom section 155 of fourth leg 124 have an outer diameter 154 that is less than an outer diameter 156 of the remaining section of fourth leg 124. As also illustrated in FIG. 1, attached to second end or fourth foot 112 of second frame 104 is a cap 164. Cap 164 is a fourth cap attached to second end or fourth foot 112 and a third cap 162 is attached to first end or third foot 110 of second frame 104. While fourth leg 124 of second frame 104 bottom section 155 having outer diameter 156, the entirety of third leg 120 of second frame 104 has the same outer diameter as the remaining section of fourth leg 124, which is substantially equal to outer diameter 156.

As discussed above, a plurality of stackable shelf units 100 can be arranged in a first configuration where at least two stackable shelf units 100 are positioned side-by-side or adjacent to each other to provide more shelf space in a closet and the like. In this first configuration, the user is desirous of providing low and long horizontal shelving. As also discussed above, a plurality of stackable shelf units 100 can be arranged in a second configuration where stackable shelf units 100 are positioned on top of each other to provide more shelf space in a closet and the like. In this second configuration, the user is desirous of providing higher and more vertical shelving.

Figure 7:
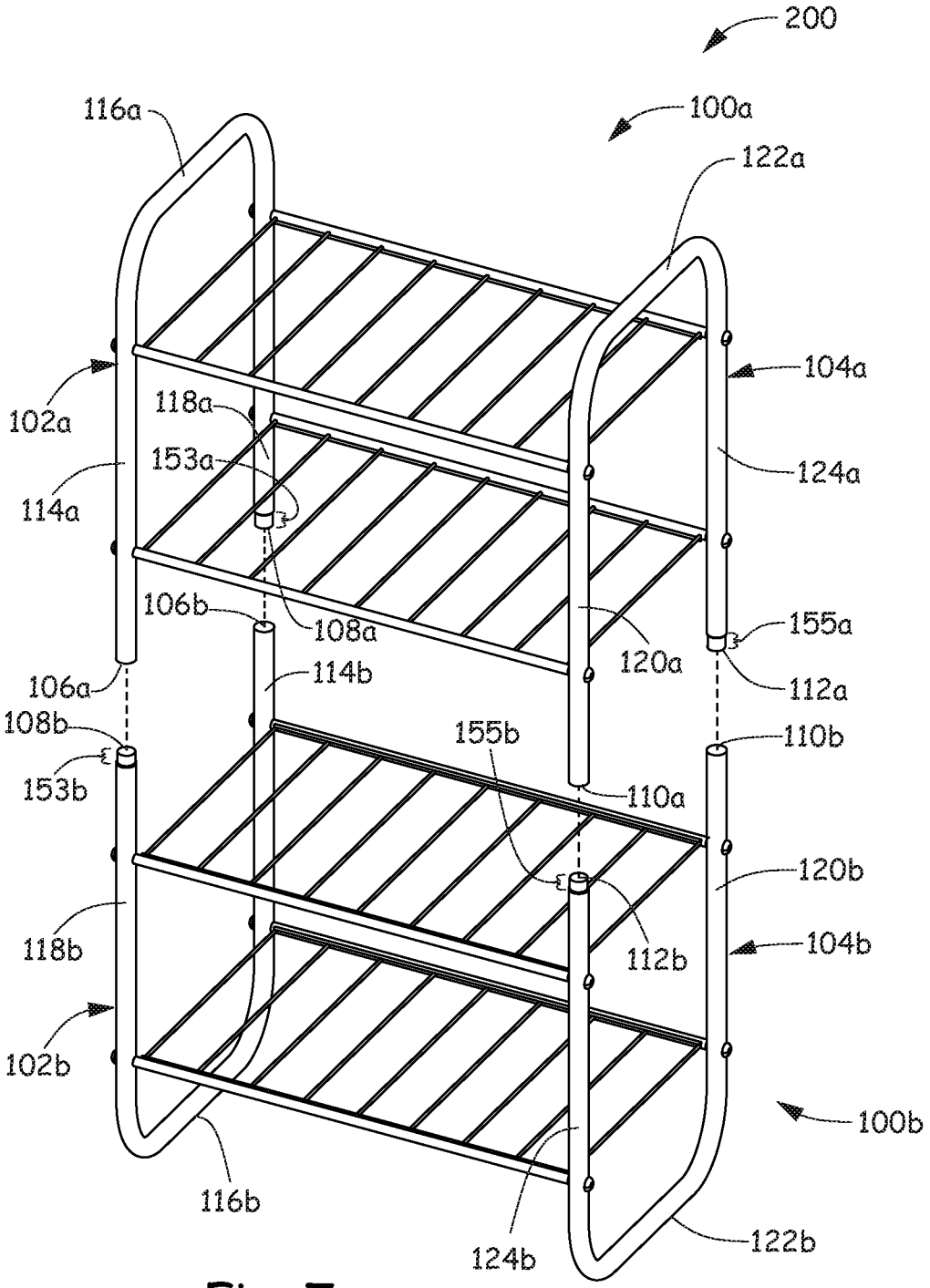
FIG. 7 is an exploded view of a shelf rack having two of the stackable shelf units of FIG. 1.

FIG. 7 is an exploded view of shelf rack 200 including identical stackable shelf units 100*a* and 100*b*. To stack shelf units 100*a* and 100*b*, other than removing caps 158, 160, 162 and 164, no amount of component separation or recombination (modularity) is required. Rather, stackable shelf unit 100*b* is flipped, turned upside down or inverted so that top portions 116*b* and 122*b* of first and second frames 102*b* and 104*b* become the bottoms or feet of shelf unit 100*b* and first and second ends 106*b* and 108*b* of first frame 102*b* and first and second ends 110*b* and 112*b* of second frame 104*b* become the tops of shelf unit 100*b*. Shelf unit 100*a* remains oriented the same as shelf unit 100 in FIGS. 1-5. However, first and second ends 106*a* and 108*a* of first frame 102*a* mate with or toollessly assemble to second and first ends 108*b* and 108*b*, respectively, of first frame 102*b* and first and second ends 110*a* and 112*a* of second frame 104*a* mate with or toollessly assemble to second and first ends 112*b* and 110*b*, respectively, of second frame 104*b* to form an assembled shelf rack 200.

In particular and in the embodiment illustrated in FIG. 7 where first frames 102*a* and 102*b* and second frames 104*a* and 104*b* are made of tubular members, an inner tubular surface of first leg 114*a* of shelf unit 100*a* receives tapered second foot 108*b* of second leg 118*b* of shelf unit 100*b*. An inner tubular surface of first leg 114*b* of shelf unit 100*b* receives tapered second foot 108*a* of second leg 118*a* of shelf unit 100*a*. An inner tubular surface of third leg 120*a* of shelf unit 100*a* receives tapered fourth foot 112*b* of fourth leg 124*b* of shelf unit 100*b*. An inner tubular surface of third leg 120*b* of shelf unit 100*b* receives tapered fourth foot 112*a* of fourth leg 124*a* of shelf unit 100*a*. In accordance with some embodiments, the receiving of tapered sections by untapered sections of tubular members comprise a press-fit connection. For example, tapered second foot 108*b* is press-fit into the inner tubular surface of first leg 114*a*, tapered second foot 108*a* is press-fit into the inner tubular surface of first leg 114*b*, tapered fourth foot 112*b* is press-fit into the inner tubular surface of third leg 120*a* and tapered fourth foot 112*a* is press-fit into the inner tubular surface of third leg 120*b*. Therefore, no other fasteners are needed to keep shelf units 100*a* and 100*b* secured together.

Figure 8:
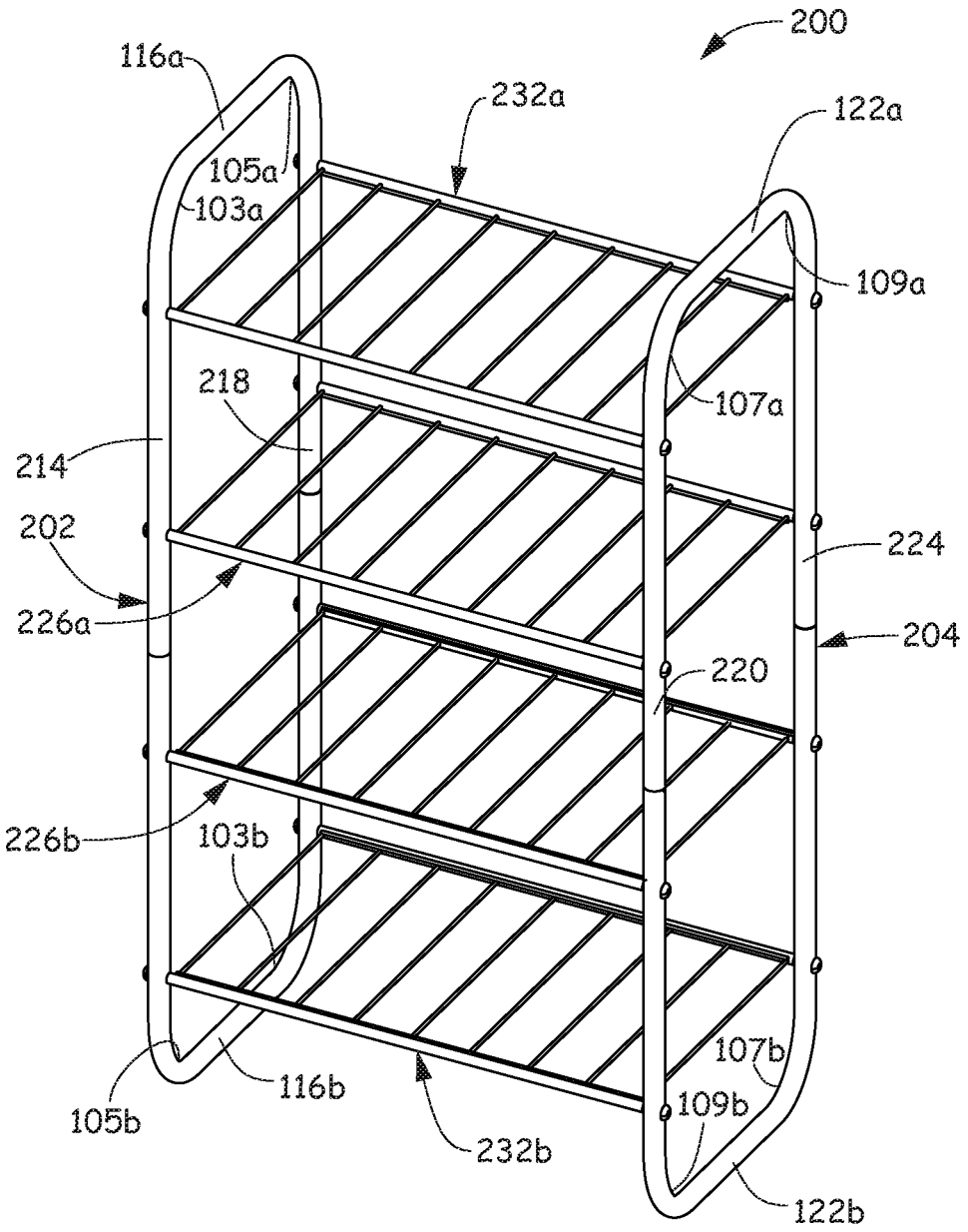
FIG. 8 is an assembled perspective view of the shelf rack exploded in FIG. 7.
Figure 9:
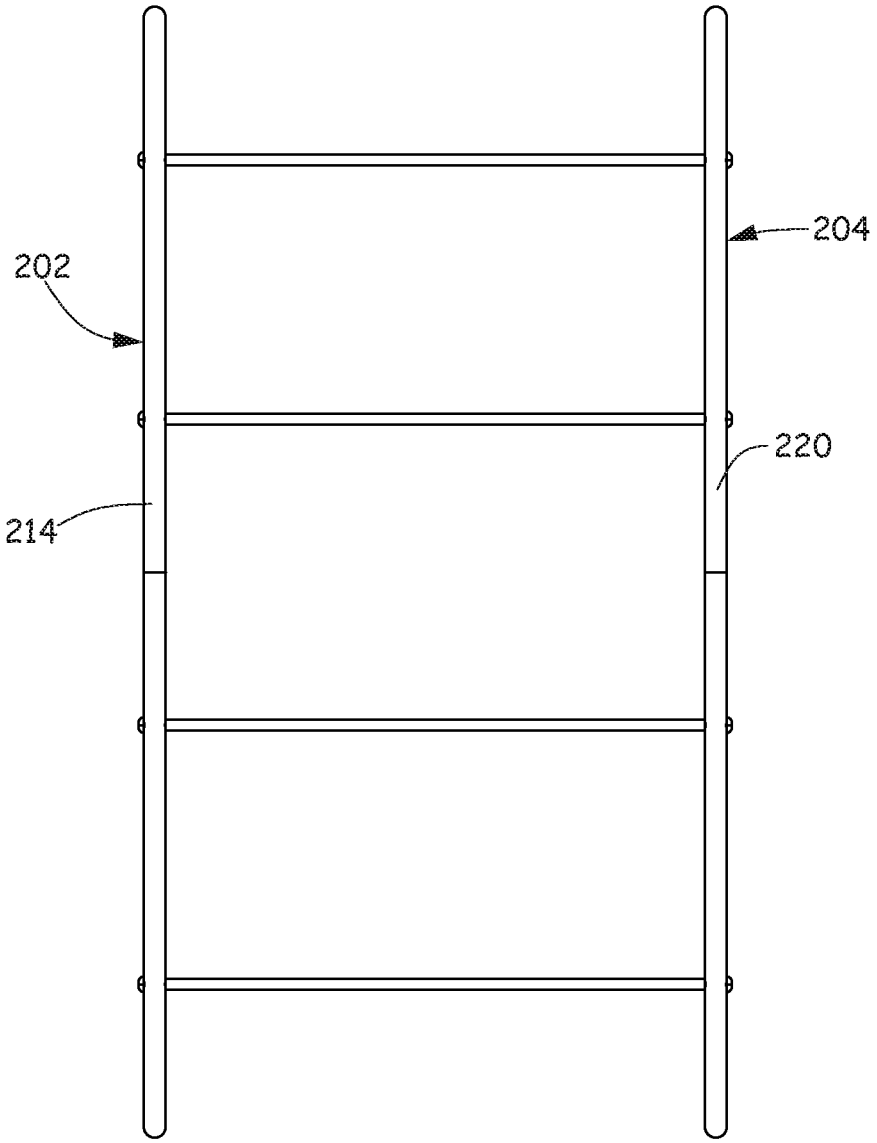
FIG. 9 is an assembled front view of the shelf rack exploded in FIG. 7.
Figure 10:
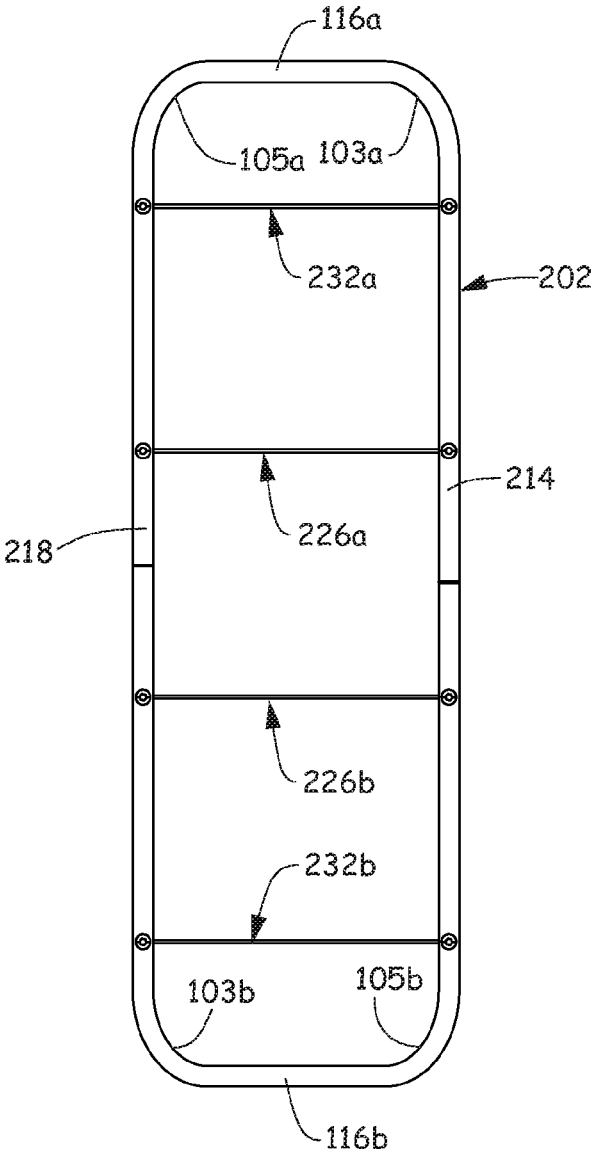
FIG. 10 is an assembled side view of the shelf rack exploded in FIG. 7.
Figure 11:
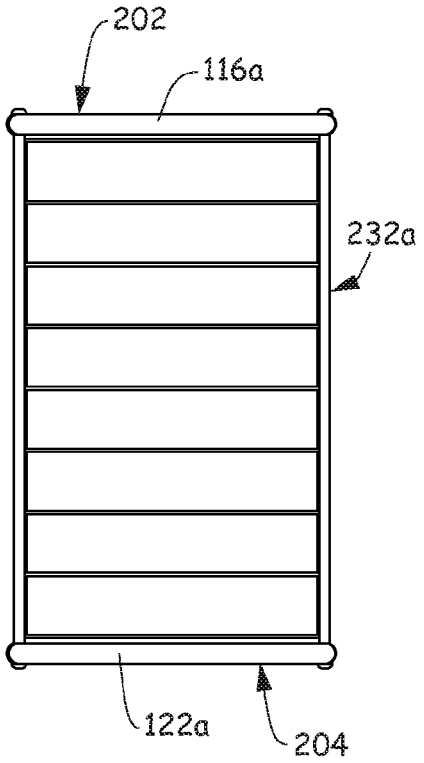
FIG. 11 is an assembled top view of the shelf rack exploded in FIG. 7.

FIG. 8 is an assembled perspective view of shelf rack 200 including assembled identical stackable shelf units 100*a* and 100*b*. FIG. 9 is a front view of FIG. 8, the back view being identical, FIG. 10 is a left side view of FIG. 8, the right side view being identical and FIG. 11 is a top view of FIG. 8, the bottom view being identical. As illustrated in FIGS. 8-11, the resulting shelf rack 200 of assembled shelf units 100*a* and 100*b* includes a four-shelf or four level rack. First frames 102*a* and 102*b* become a first frame 202 of shelf rack 200 and second frames 104*a* and 104*b* become a second frame 204 of shelf rack 200.

Each of first frame 202 and second frame 204 form a continuous tubular metal structure that has no ends. In other words, first frame 202 extends from substantially horizontally oriented top portion 116*a* to a first bend 103*a* and down a substantially vertically oriented first leg 214 to a second bend 105*b*, extends along a substantially horizontally oriented bottom portion 116*b* to a third bend 103*b* and extends up a substantially vertically oriented second leg 218, to a fourth bend 105*a*. Top portion 116*a* is defined between first bend 103*a* and fourth bend 105*a* and bottom portion 116*b* is defined between second bend 105*b* and third bend 103*b*. First leg 214 is defined between first bend 103*a* and second bend 105*b* and second leg 218 is defined between third bend 103*b* and fourth bend 105*a*.

Second frame 204 extends from substantially horizontally oriented top portion 122*a* to a first bend 107*a* and down a substantially vertically oriented first leg 220 to a second bend 109*b*, extends along a substantially horizontally oriented bottom portion 122*b* to a third bend 107*b* and up a substantially vertically oriented second leg 224 to a fourth bend 109*a*. Top portion 122*a* is defined between first bend 107*a* and fourth bend 109*a* and bottom portion 122*b* is defined between second bend 109*b* and third bend 107*b*. First leg 220 is defined between first bend 107*a* and second bend 109*b* and second leg 224 is defined between third bend 107*b* and fourth bend 109*a*.

Four shelves are located between first frame 202 and second frame 204 and comprise an upper most shelf 232*a*, two middle shelves 226*a* and 226*b* and a lower most shelf 232*b*. As illustrated, shelf unit 100*b* has been flipped so that the upper shelf 132*b* of shelf unit 100*b* becomes the lower most shelf 232*b* of shelf rack 200 and the lower shelf 126*b* becomes the middle shelf 226*b* of shelf rack 200. Shelf unit 100*a* is not flipped. In this way, the upper shelf 132*a* of shelf unit 100*a* remains the upper most shelf 232*a* of shelf rack 200 and the lower shelf 126*a* becomes the middle shelf 226*a* of shelf rack 200.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A shelf rack comprising:

first and second identical shelf units each including a first frame with first and second legs having respective first and second feet, a second frame with third and fourth legs having respective third and fourth feet and at least one shelf located between the first and second frames, wherein the second and fourth feet have an outer diameter that is less than an outer diameter of the first and third feet;

wherein the second shelf unit is turned upside down and the first and second frames of the first shelf unit toollessly assemble to the first and second frames, respectively, of the second shelf unit; and wherein toollessly assembling first and second shelf units comprise mating the feet of the first shelf unit having the smaller outer diameter with the feet of the second shelf unit having the larger out diameter and mating the feet of the second shelf unit having the larger outer diameter with the feet of the first shelf unit having the smaller outer diameter.

2. The shelf rack of claim 1, wherein the first frame and the second frame of each shelf unit comprise a continuous tubular member.

3. The shelf rack of claim 2, wherein the first frame and the second frame each have a first bend and a second bend and defined between the first bend and the first foot of the first frame is the first leg, defined between the second bend and the second foot of the first frame is the second leg, defined between the first bend and the third foot of the second frame is the third leg and defined between the second bend and the fourth foot of the second frame is the fourth leg.

4. The shelf rack of claim 2, wherein an inner tubular surface of the first leg of the first shelf unit receives the second foot of the second leg of the second shelf unit, an inner tubular surface of the first leg of the second shelf unit receives the second foot of the second leg of the first shelf unit, an inner tubular surface of the third leg of the first shelf unit receives the fourth foot of the fourth leg of the second shelf unit and an inner tubular surface of the third leg of the second shelf unit receives the fourth foot of the fourth leg of the first shelf unit.

5. The shelf rack of claim 1, wherein the top portions of the first and second frames of the second shelf unit comprises a bottom of the assembled shelf rack.

6. The shelf rack of claim 1, wherein the first shelf unit and the second shelf unit each comprise four caps that cover each of the first, second, third and fourth feet, wherein the four caps on each of the first and second shelf units are removed before the second shelf unit is mated with the first shelf unit.

7. The shelf rack of claim 1, wherein the at least one shelf located between the first frame and the second frame of each of the first and second shelf units comprises two shelves located between the first frame and the second frame of each of the first and second shelf units so that the assembled shelf rack comprises four shelves.

8. The shelf rack of claim 1, wherein the first and second feet of the first frame of the second shelf unit comprise a press-fit connection with the first and second feet of the first frame of the first shelf unit and the third and fourth feet of the second frame of the first shelf unit comprise a press-fit connection with the third and fourth feet of the second frame of the second shelf unit.

9. A shelf rack comprising:

first and second identical shelf units, each shelf unit including;

a first frame comprising a continuous member and having a first end, a first bend a second bend and a second end, wherein defined between the first end of the first frame and the first bend of the first frame is a first leg of each shelf unit, defined between the first bend and the second bend of the first frame is a top portion of the first frame and defined between the second bend and the second end of the first frame is a second leg of each shelf unit;

a second frame comprising a continuous member and having a first end, a first bend, a second bend and a second end, wherein defined between the first end of the second frame and the first bend of the second frame is a third leg of each shelf unit, defined between the first bend and the second bend of the second frame is a top portion of the second frame and defined between the second bend and the second end of the second frame is a fourth leg of each shelf unit;

at least one shelf positioned between the first frame and the second frame of each of the first and second shelf units;

wherein the second shelf unit is inverted so that the first and second ends of the first frame of the second shelf unit mate with the second and first ends of the first frame of the first shelf unit and the first and second ends of the second frame of the second shelf unit mate with the second and first ends of the second frame of the first shelf unit to form an assembled shelf rack.

10. The shelf rack of claim 9, wherein the second leg of each shelf unit comprises a section that extends from the second end of the first frame to a point along the second leg of each shelf unit and wherein the fourth leg of each shelf unit comprises a section that extends from the second end of the second frame to a point along the fourth leg of each shelf unit, wherein the section of the second leg has an outer diameter that is less than an outer diameter of a remaining section of the second leg and the section of the fourth leg has an outer diameter that is less than an outer diameter of a remaining section of the fourth leg.

11. The shelf rack of claim 10, wherein the continuous member of the first frame and the continuous member of the second frame comprise tubular members, wherein an inner tubular surface of the first leg of the first shelf unit receives the section of the second leg of the second shelf unit, an inner tubular surface of the first leg of the second shelf unit receives the section of the second leg of the first shelf unit, an inner tubular surface of the third leg of the first shelf unit receives the section of the fourth leg of the second shelf unit and an inner tubular surface of the third leg of the second shelf unit receives the section of the fourth leg of the first shelf unit.

12. The shelf rack of claim 9, wherein the top portions of the first and second frames of the second shelf unit comprise a bottom of the assembled shelf rack.

13. The shelf rack of claim 9, wherein the first shelf unit and the second shelf unit each comprise four caps that cover each of the first and second ends of the first and second frames, wherein the four caps on each of the first and second shelf units are removed before the second shelf unit mates with the first shelf unit.

14. The shelf rack of claim 9, wherein the at least one shelf positioned between the first frame and the second frame of each of the first and second shelf units comprises two shelves located between the first frame and the second frame of each of the first and second shelf units so that the assembled shelf rack comprises four shelves.

15. The shelf rack of claim 9, wherein the first and second ends of the first frame of the first shelf unit that mate with the first and second ends of the first frame of the second shelf unit comprise press-fit connections and wherein the first and second ends of the second frame of the first shelf unit that mate with the first and second ends of the second frame of the second shelf unit comprise press-fit connections.

16. A method of assembling a shelf rack comprising:

obtaining first and second identical shelf units each having a first frame, a second frame and at least one shelf therebetween;

turning the second shelf unit upside down so that a top of the second shelf unit rests on a floor; and toollessly connecting the first frame of the first shelf unit to the first frame of the second shelf unit and the second frame of the first shelf unit to the second frame of the second shelf unit to form the shelf rack; and wherein a top of the shelf rack comprises the top of the first shelf unit and a bottom of the shelf rack comprises the top of the second shelf unit.

17. The method of claim 16, wherein each of the first frame and the second frame comprise a tubular member having a first end and a second end and bends for defining a pair of legs.

18. The method of claim 17, wherein each of the first frame and the second frame comprise a section that extends from the second end of each frame to a point along one of the pair of legs and a remaining section that extends from the first end of each frame along the other of the pair of legs, wherein the section includes an outer diameter that is less than an outer diameter of the remaining section.

19. The method of claim 18, wherein toollessly connecting the first frame of the first shelf unit to the first frame of the second shelf unit comprises inserting the sections of the first and second shelf units into the remaining sections of the first and second shelf units.

20. The method of claim 19, wherein inserting the sections of the first and second shelf units with the remaining sections of the first and second shelf units comprises press-fitting the sections of the first and second shelf units into the remaining sections of the first and second shelf units.

* * * * *